US005289873A

United States Patent [19]

Ryan et al.

[11] Patent Number: 5,289,873

[45] Date of Patent: Mar. 1, 1994

[54] HEAT EXCHANGER SIDEPLATE INTERLOCKED WITH HEADER

[75] Inventors: Richard P. Ryan, East Amherst; Gary A. Halstead, Lockport, both of N.Y.; Glenn W. Shaffer, Tuscaloosa, Ala.; Shrikant M. Joshi, Cambridge, Mass.

[73] Assignee: General Motors Corporation, Detroit, Mich.

[21] Appl. No.: 902,158

[22] Filed: Jun. 22, 1992

[51] Int. Cl.[5] ..... F28F 9/26

[52] U.S. Cl. ..... 165/149; 165/153; 165/78

[58] Field of Search ..... 165/149, 153, 173, 78; 29/890.052; 228/183

[56] References Cited

U.S. PATENT DOCUMENTS

| | | | |
|---|---|---|---|
| 3,310,869 | 3/1967 | LaPorte et al. | 29/157.3 |
| 3,960,210 | 6/1976 | Chartet | 165/149 |
| 4,569,390 | 2/1986 | Knowlton et al. | 165/149 |
| 4,938,284 | 7/1990 | Howells | 165/149 |
| 5,009,262 | 4/1991 | Halstead et al. | 165/140 |

*Primary Examiner*—Allen J. Flanigan

*Attorney, Agent, or Firm*—Patrick M. Griffin

[57] ABSTRACT

A heat exchanger apparatus includes a pair of tank units for containing a fluid, such as an engine coolant, or freon, each including a header having a plurality of slots for receiving a plurality of parallel fluid flow tubes in fluid communication between the tanks. Air centers are connected between the parallel fluid flow tubes for directing an inlet air stream of the vehicle. Side plates are secured between the ends of the headers to protect and provide rigidity to the heat exchanger. Interlocking members are provided between the headers and sideplates for interlocking same to one another during the brazing process.

1 Claim, 2 Drawing Sheets

HEAT EXCHANGER SIDEPLATE INTERLOCKED WITH HEADER

TECHNICAL FIELD

The invention relates to heat exchangers having parallel tube passes and air centers for directing the inlet air stream of a vehicle through passes in the exchanger, and more particularly to heat exchanger having headered tanks and the formation thereof.

BACKGROUND OF THE INVENTION

Heat exchangers, such as coolant radiators and condensers utilized in automotive vehicles, generally include a pair of tanks for containing cooling fluid. The tanks are formed with headers having slots therethrough for receiving fluid tubes or tube passes for directing the cooling fluid between the parallel tanks. Air centers are connected between the parallel tube passes for directing air through the heat exchanger. The air cools the fluid within the heat exchanger passing through the air passes.

The U.S. Pat. No. 3,310,869, issued Mar. 28, 1967 in the name of Porte et al. discloses a method of making radiators having a core section between two parallel fluid tanks. Sideplates are formed abutting the tanks between the end plates of the tanks to enclose the sides of the core between the tanks and sideplates.

The U.S. Pat. No. 5,009,262, issued Apr. 23, 1991 in the name of Halstead et al. discloses a combination radiator and condenser apparatus for a vehicle having extruded tank and header assemblies interconnected by the parallel tube passes and air centers.

SUMMARY OF THE INVENTION

The invention relates to a heat exchanger apparatus for a vehicle. The apparatus includes a pair of tank and header units for providing a coolant space, a plurality of tube passes including flow tubes forming a coolant passage connected between the tank and header units, and air center means connected to each of the aligned flow tubes for conductively transferring heat from the coolant forming a core with the tube passes. The tank and header units each include a tank extrusion and header for forming the coolant space with the flow tubes and air center means connected between the headers. A pair of sideplates extend between the headers about the core and parallel with the flow tubes for supporting the core between the headers and side plates. Interlocking means is operatively connected between the headers and side plates for locking the side plates to the headers to support the core.

More particularly, the interlocking means includes a locking tab extending from the ends of the header and a receiving notch within the sideplates for receiving the locking tab therein.

BRIEF DESCRIPTION OF THE DRAWINGS

Advantages of the present invention will be readily appreciated as the same becomes better understood by reference to the following detailed description when considered in connection with the accompanying drawings wherein.

DESCRIPTION OF THE PREFERRED EMBODIMENT

Figure 1:
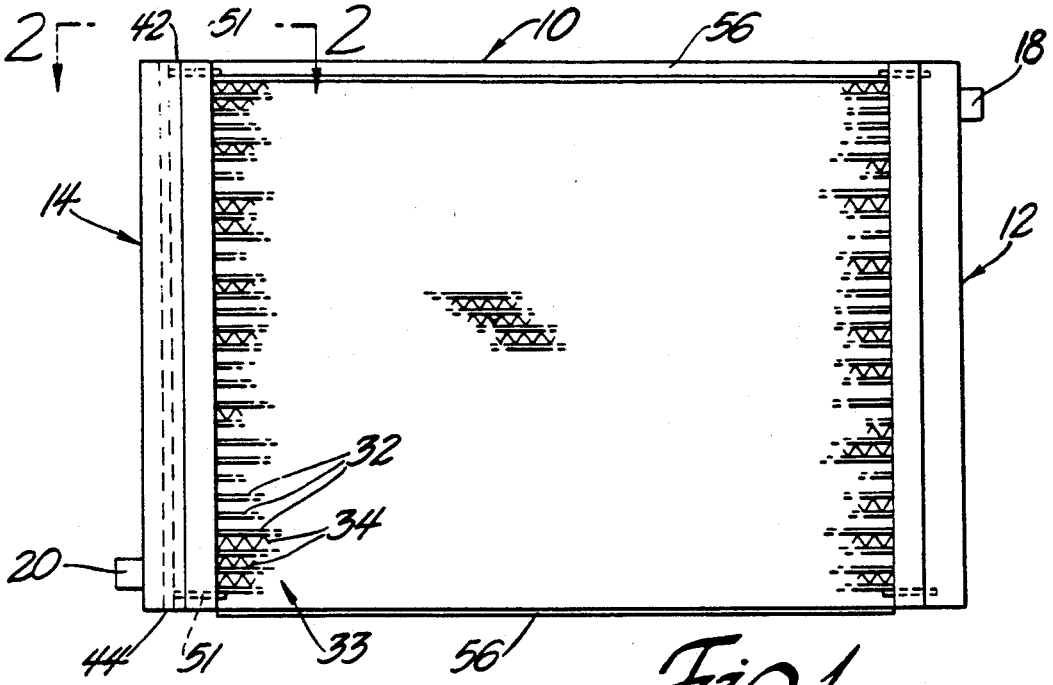
FIG. 1 is an enlarged front elevational view of a heat exchanger of the subject invention.

FIG. 1 generally shows a heat exchanger 10 of the present invention. More particularly, the heat exchanger 10 may be a radiator or condenser adapted to be installed within the engine compartment of a motor vehicle having a liquid cooled engine and air conditioning system. The heat exchanger 10 includes a pair of tank and header units 12,14 for providing a liquid or coolant space 16. An inlet fitting 18 is secured to the inlet tank unit 12 and an outlet fitting 20 is connected to the outlet tank unit 14. The fittings 18,20 communicate with coolant hoses for supplying fluid or refrigerant to and from the coolant chambers or spaces 16 in the inlet and outlet tank units 18,20. The tank and header units 12,14 each include a tank extrusion 22 and a header 24 for forming the coolant space 16 which receives a coolant fluid therein. The tank extrusion 22 is generally formed as an extrusion having a mounting rail 25 with side flanges 26, and parallel side walls 28 integrally connected with the mounting rail 25 for receiving the header 24 therein.

Figure 5:
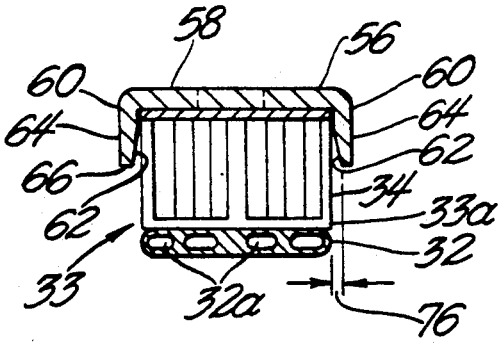
FIG. 5 is a cross-sectional view of the sideplate and core taken along lines 5—5 of FIG. 2.

A core 33 is formed between the headers 24 by parallel flow tubes 32 and air centers 34. The header 24 includes a plurality of slots 30 therein for receiving the plurality of parallel flow tubes 32 comprising either extruded tubes or sheet metal tubes of a flat configuration as shown in FIG. 5. The coolant fluid flows between the parallel tank units 12,14 through the aligned parallel flow tubes 32 for extracting heat from the coolant flow therethrough as air passes through the heat exchanger 10. Air centers 34 are connected and extend between each of the aligned flow tubes for conductively transferring heat from the coolant fluid. As commonly known in the art, such air centers 34 are generally sinusoidally curved sheet metal members with peaks and valleys bonded to the surface of the tube extrusions 32 in conductive heat transfer relationship therewith for removing heat from the flow paths during initial flow of the inlet air stream through the air center gap. The configuration of the flow tubes 32 and the air centers 34 is more specifically disclosed in U.S. Pat. No. 5,009,262, which is incorporated by reference herein.

The side walls 28 include internal integral tube stops 36 therein aligned with the plurality of spaced slots 30 on the header 24. The slots 30 receive end extensions 38 on either end of a common tube extrusion 32 forming a tube pass between the inlet tank unit 12 and the outlet tank unit 14. The end extensions 38 engage the tube stops 36 to locate the end extensions 38 in spaced relationship to the tank units 12,14 so as to define a gap therebetween for smooth flow of fluid from passages **32*a* in the tube extrusions 32 and the chamber spaces 16. It is to be understood that any type of tank and header unit may be utilized, such as that disclosed in U.S. Pat. No. 5,009,262, cited in the Background of the Invention and referenced herein. The side walls 28 extend from the tube stops 36 forming opposing clamp arms 50 having a notch 54 therein for receiving the side edges 24*a* of the header 24**.

Figure 2:
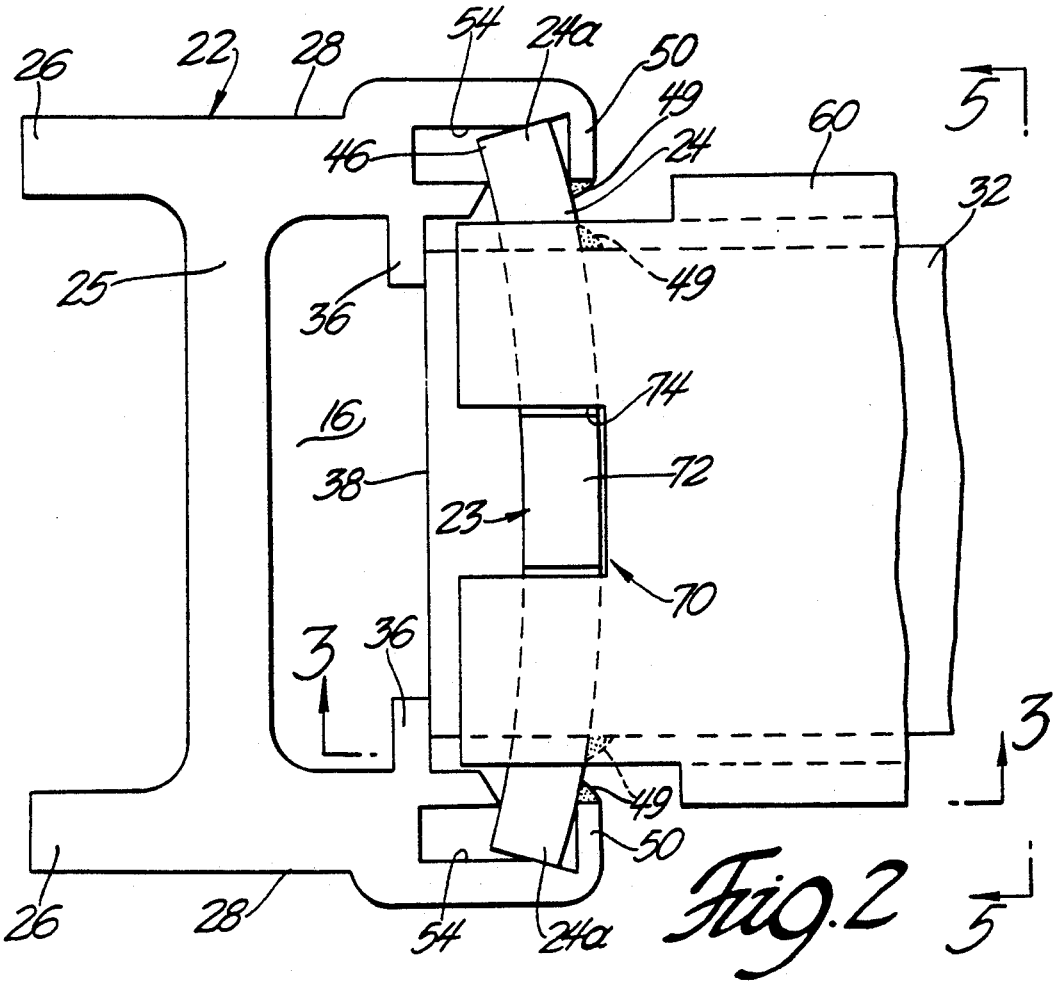
FIG. 2 is an end view taken along lines 2—2 of FIG. 1 excluding the end plate.
Figure 3:
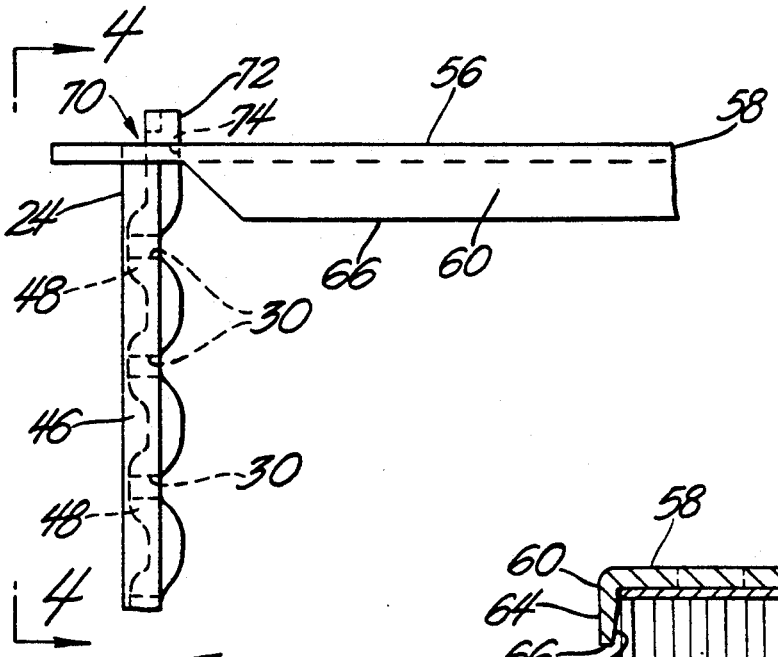
FIG. 3 is a cross sectional view taken along lines 3—3 of FIG. 2 of the header and sideplate.

Each header 24 includes first and second ends 42,44. The header 24 is formed with raised or arcuate portions 48 between slots 30 as illustrated in FIG. 3. The cross-section through the longitudinal axis of the header 24 is generally arcuate as illustrated in FIG. 2.

The tank extrusion 22 and header 18 are brazed for forming brazed joints 49 therebetween for sealing the fluid within the tank units 12,14. End plates 51 are brazed or soldered to the ends of the tank and header unit 12 to seal the coolant space therein.

Figure 4:
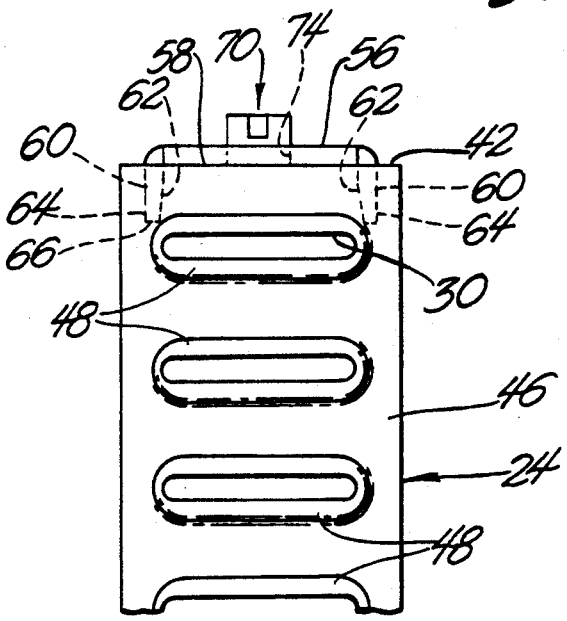
FIG. 4 is a fragmentary, end elevational view taken along lines 4—4 of FIG. 3.

As best shown in FIGS. 3–5, the core is reinforced by sideplates 56 extending between the ends 42,44 of the headers and parallel with the flow tubes 32. The sideplates 56 are each comprised of a generally longitudinally extending U-shaped extrusion providing a base 58 and a pair of parallel arms 60 extending from the base 58. The base 58 extends beyond the longitudinal length of the parallel arms 60 (FIG. 3) to extend over the ends 42,44 on the header 24. The parallel arms 60 include an interior surface 62 and exterior surface 64. The exterior surfaces 64 of the arms 60 are generally parallel. The interior surfaces 62 are tapered from the base 58 for receiving the core 33. The interior surfaces 62 are tapered from the base 58 such that the thickness of the arm 60 at the base 58 is greater than the thickness at the tips 66 of the arms 60. The tapered arms 60 allow for easy assembly by defining a lead-in for the core 33.

The heat exchanger 10 also includes interlocking means 70 operatively connected between the headers 24 and the sideplates 56 for locking the sideplates 56 to the header 24 to maintain assembly during brazing thereof. The interlocking means 70 includes a locking member 72 on the ends 42,44 of the headers 24 and a receiving member 74 on the ends 68,69 of the sideplates 56 for interlocking with one another. More specifically, the locking member 72 comprises a planar tab 72 extending from the ends 42,44 of the header 24. The receiving member 74 comprises a notch in the base 58 of the sideplates 56 of a width complementary to that of the tab 72 so as to securely receive a header tab 72 therein to lock the sideplates 56 to the headers 24 during brazing thereof.

The tabs 72 and notches 74 allow the sideplates 56 and headers 24 to interlock to secure the core 33. This rigidifies the core 33 so as to prevent the core 33 from shifting during post assembly transport. The interlocking means 70 also prevents the core from shifting and sagging during the brazing cycle. It also eliminates the need to use fixture or trays for core 33 containment during brazing. During the brazing operation after assembly of the core 33, side plates 56, header 24 and tank, the sideplates 56 support the core 33 throughout the process. A gap 76 (shown in FIG. 5) is provided between the core face **33*a* and the processing equipment at the tapered parallel arms 60 which engage the processing equipment to raise the core face 33*a* from touching the metal portions of a conveyor at the critical braze temperature. Accordingly, after brazing, the flow tubes 32 and air centers 34 of the core 33** remain free of damage such as formation of unwanted depressions in the core face which otherwise can be caused in prior art heat exchangers which do not have such protective flanges.

The invention has been described in an illustrative manner with reference to a radiator but it is equally suited for use with other heat exchangers such as condensers or oil coolers. Accordingly, it is to be understood that the terminology which has been used is intended to be in the nature of words of description rather than of limitation.

Obviously many modifications and variations of the present invention are possible in light of the above teachings. It is, therefore, to be understood that within the scope of the appended claims the invention may be practiced otherwise than as specifically described.

What is claimed is:

1. A heat exchanger apparatus for a vehicle, said apparatus having a pair of tank and header units for providing a coolant space, a plurality of parallel tube passes including flow tubes forming a coolant passage connected between said tank and header units, air center means connected to each of said aligned flow tubes for conductively transferring heat from said coolant forming a core with said tube passes, said tank and header units each including a tank extrusion and header for forming said coolant space with said flow tube segments and air center means connected between said headers characterized by:

a pair of sideplates extending between said headers about said core and parallel with said flow tubes for supporting said core between said headers and sideplates;

interlocking means operatively connected between said headers and said sideplates for locking said sideplates to said headers to support said core;

said interlocking means includes a tab extending from said first and second ends of said headers and a notch extending into said sideplates for receiving said tabs to align said sideplates parallel with said tube passes and said air center means;

each of said sideplates comprising a longitudinally extending U-shaped extrusion having a base and a pair of parallel arms extending from said base wherein said notch is formed within said base;

said parallel arms including an inside surface and an exterior surface, said exterior surfaces being substantially parallel to one another, said interior surfaces being tapered toward said exterior surfaces for receiving said tube passes; and said pair of side plates comprised of a longitudinal extending U-shaped extrusion having arms for extending over said core to support said core on a processing conveyor in spaced relationship thereto.

* * * * *